United States Patent [19]

Durenec et al.

[11] Patent Number: 4,524,675

[45] Date of Patent: Jun. 25, 1985

[54] DETACHABLY CONNECTABLE SIGHT ASSEMBLY FOR A SMALL DEFENSE WEAPON

[75] Inventors: Peter Durenec, Annandale; Clifford E. Lowe, Fredricksburg, both of Va.

[73] Assignee: The United States of America as represented by the Secretary of the Army, Washington, D.C.

[21] Appl. No.: 404,783

[22] Filed: Aug. 3, 1982

[51] Int. Cl.[3] ..... F41G 1/38

[52] U.S. Cl. ..... 89/41.03; 33/233

[58] Field of Search ..... 33/233, 235, 247, 248, 33/250, 257; 39/13.05, 13 K, 13.1, 13 A, 41 B, 41 L; 42/1 S, 1 ST; 350/1.1

[56] References Cited

U.S. PATENT DOCUMENTS 3,471,932 10/1969 Luning ..... 33/248

FOREIGN PATENT DOCUMENTS 972621 10/1964 United Kingdom ..... 33/248

*Primary Examiner*—Bruce Y. Arnold
*Assistant Examiner*—Bruce S. Shapiro
*Attorney, Agent, or Firm*—Anthony T. Lane; Milton W. Lee; Aubrey J. Dunn

[57] ABSTRACT

A night sight assembly in conjunction with a day sight which is easily connected and disconnected in total darkness to small defense weapons systems. The assembly is comprised of an infrared viewer amounted on a cradle which is easily connected and disconnected to a small weapon system.

8 Claims, 4 Drawing Figures

DETACHABLY CONNECTABLE SIGHT ASSEMBLY FOR A SMALL DEFENSE WEAPON

The invention described herein may be manufactured, used and licensed by the U.S. Government for governmental purposes without the payment of any royalties thereon.

BACKGROUND OF THE INVENTION

1. Field of the Invention

The present invention is combined day/night sight assembly for small military weapons generally of the air defense type.

2. Description of Prior Art

Many air defense systems in use today are limited to operation in daylight, fair weather and a reduction in capability for target acquisition as the level of haze and/or fog increases. The addition of a night vision capability sighting device along with the day sight can more than double the target acquisition effectiveness of air defense systems over the full 24 hour day-night period.

Changing from a day sight to a night sight or vice versa on the weapons can be rather cumbersome and time consuming, especially when the conversion is made at nightime.

SUMMARY OF THE INVENTION

The present invention is comprised of a modification of an existing day sight assembly on air defense weapons systems, shown and explained herein as the Stinger air defense missile weapon system but not limited to this weapon or even this type shoulder fired weapon, to further include a night sight therewith which is attached by the present attachment means to the weapon system. The day/night sight assembly is mounted on a throw-away launcher tube in a quick connect and, after launching the missile, a quick disconnect manner and then quick reconnect to the next launcher tube. The night sight used is preferably of the infrared viewer type, being either in a short and flat housing with offset optics system therein or in an elongated housing in parallel with the weapon bore, i.e. boresighted, and housing an in-line optics system. One night sight that may be used, but not limited thereto, is the U.S. Army infrared viewer, AN/PAS-7, which is of particular benefit for detecting targets in complete darkness of during poor visibility and behind foliage. This type viewer operates in the 3–5 $\mu$M region cooled by a thermoelectric cooler or in the 8–12 $\mu$M region without being cooled.

The attachment means is comprised of mounting cradle upon which the night sight is first attached, having elevation and azimuth adjustment means for adjusting the boresight of the night sight from an underside of the cradle. Prior to attachment of the night sight cradle to the weapon, the day sight is flipped down to the side of the weapon launcher tube. The cradle has front and rear legs extending down from the plate upon which the night sight is mounted and which have front and rear connecting and disconnecting means and antirocking means thereon for securing to said weapon. The front and rear connecting and disconnecting means are comprised of front and rear holes therein through which front and rear slip pins respectively fit. The front and rear pins also fit through holes in the day sight and the launcher weapon. At least one of the legs, preferably the front leg, has antirocking means in the form of an offset pin that fits into the day sight. Each of the legs have rounded surfaces that match the curvature of the laucher tube to prevent rotatinal movement of the night sight when attached to the weapon launcher tube. The night sight and cradle combination may be easily removed and the day sight flipped back up for use during daylight.

DETAILED DESCRIPTION OF THE PREFERRED EMBODIMENT

Figure 1:
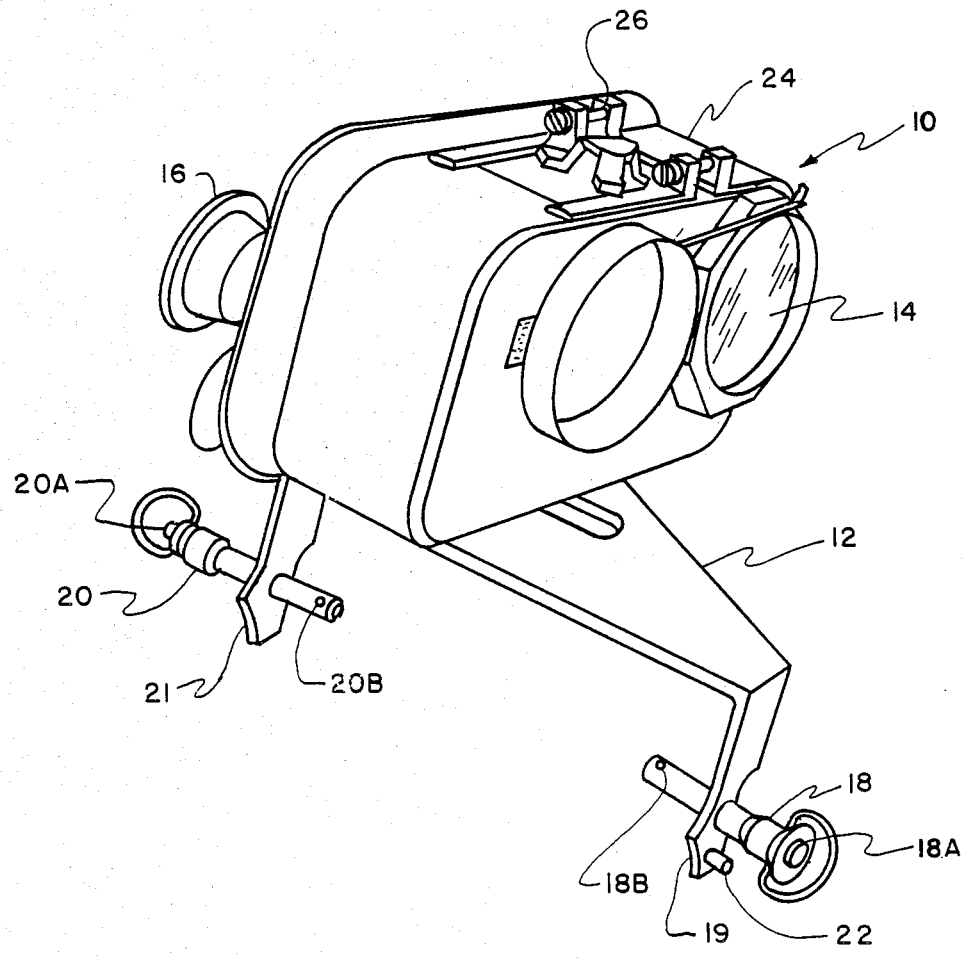
FIG. 1 is a perspective view of a night sight and cradle combination unattached to a weapon.

The night sight 10 is preferably connected to cradle 12 by a belt type bracket 24 screw threadably attached by two sets of clamp screws 26 on the top of night sight 10 and connected means on the bottom to the cradle, which connecting means is preferably a screw threadably means through a long slot in cradle 12. The front window of the night sight 10 is represented by numeral 14 and the eyepiece is represented by numeral 16. The cradle has a front leg with a hole 58 through which front slip pin 18 extends and a rear leg with a hole 62 through which rear slip pin 20 extends. The holes and pins will be discussed herein below with reference to FIG. 4. Pins 18 snd 20 respectively have a release button 18A that releases a clip 18B and a release 20A that releases a clip 20B when buttons 18A and 20A are depressed to facilitate the pins 18 and 20 being inserted or removed from the various holes but which hold the day/night combination sights to the launcher tube when buttons 18A and 20A are not depressed. Rounded surfaces 19 and 21 fit to the curvature of the launcher tube and, together with the antirocking pin 22 which is offset from pin 18, prevent any rotation of the cradle 12 and thus night sight 10.

Figure 2:
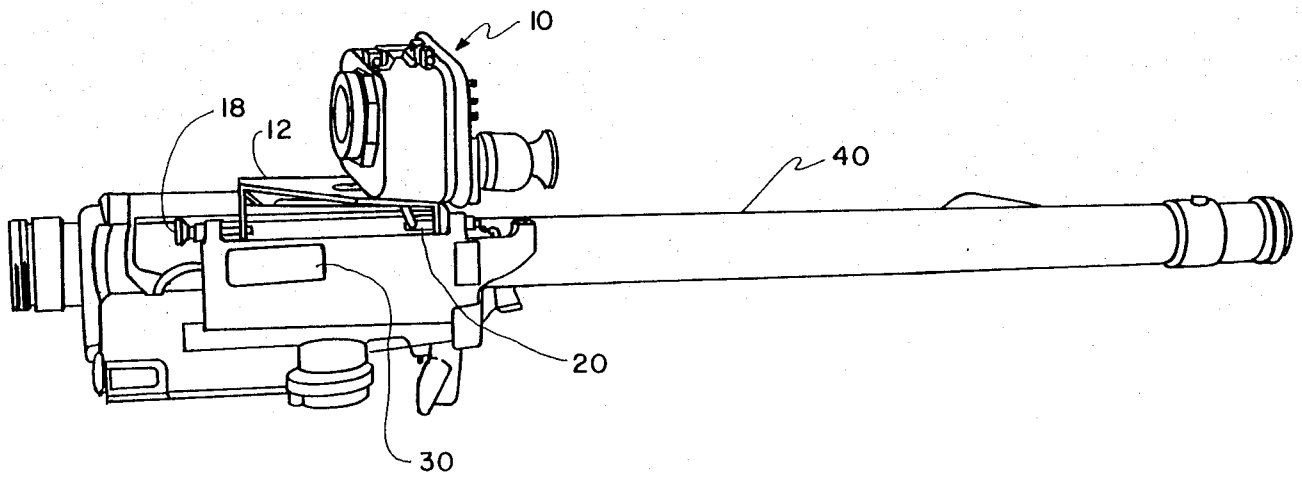
FIG. 2 shows the same night sight and cradle combination when attached to a weapon.

FIG. 2 illustrates the night sight 10 mounted on a weapon launcher tube 40 with the day sight 30 flipped down and out of the way of the gunner. The gunner will be on the near side of weapon 40 with the weapon firing toward the left as shown.

Figure 3:
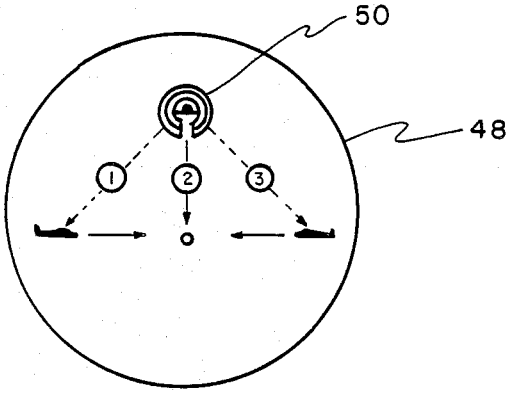
FIG. 3 illustrates a novel reticle used on the eyepiece of the night sight.

The night sight has a reticle preferably of the design as shown in FIG. 3 which is preferably a reticle plastic insert 48 placed over the end of the CRT display of the viewer. The reticle is used thusly. The enemy or target aircraft is tracked keeping the target in the rings until the aircraft fills one of the rings of the sight 50, indicating the target aircraft is within the range of the weapon, at which time the gunner quickly moves the launcher tube up and to the right or left so that the target aircraft occupies one of the positions 1,2, or 3. When the aircraft occupies one of these positions the missile is ready to be launched because the necessary elevation and azimuth lead angles are provided.

Figure 4:
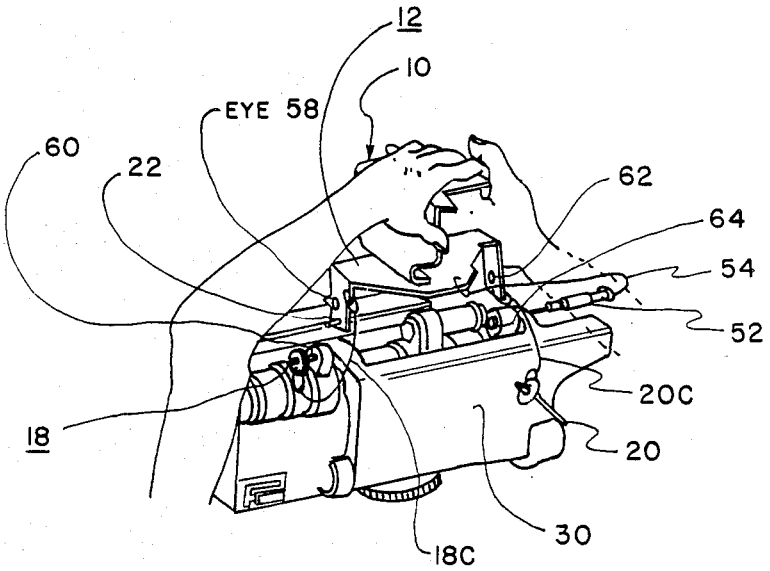
FIG. 4 is a partial view of the weapon showing more detail of the cradle and the means for attaching the cradle to the weapon.

The steps of connecting and disconnecting the night sight cradle 12 to the launcher tube 40 will now be explained with reference to FIG. 4. First, it should be noted that pins 18 and 20 will be referred to herein as front and rear replacement pins since both replace the shorter pins that previously held the day sight to the launcher tube. The legs of the night sight cradle fit between the eyerings of the day sight and the launcher. The eyerings of the day sight are usually aft of the launcher eyerings. Front and rear pins 18 and 20 are attached to cradle 12 respectively by lanyards 18C and 20C to prevent being lost during nightime change over. An alignment tool 52, which is used in connecting and disconnecting the night sight cradle, is also attached to cradle 12 by a lanyard 54. Lanyards 18C, 20C, and 54 are preferably made of some stretchable material, such as rubber material.

The connection steps of cradle 12 to the launcher tube 40 are as follows. The existing front pin is first knocked out from the front hole 59 of the day sight and front hole 60 of the launcher tube and the replacement front pin 18 is inserted from front to back through holes 60 and 59 in that order. The existing rear pin is also knocked out from the rear hole 64 of the launcher tube and the rear hole of the day sight (not visible in FIG. 4). Rear replacement pin 20 is then inserted through the rear hole 64 and the holes of the day sight in that order, i.e. also from front to back. The night sight cradle 12 is now ready to connect to the launcher tube 40. The clip 20B of rear pin 20 is released by release button 20A and the alignment tool 52, which may be made of plastic and is just slightly smaller than the holes of the launcher tube and the day sight to fit therein, is inserted flush with the inside of the launcher tube hole 64 and left there. The front pin 18 is now released in the same manner as the rear pin 20 and is moved forward only until the pin is flush with the inside of the day sight. The cradle 12 is now fitted between the day sight by first inserting the antiracking pin 22 into the front eyering of the day sight and then aligning the front hole 58 the rear hole 62 of cradle 12 with the holes of the day sight and launcher tube 59 and 64 respectively. The front pin 18 is first pressed through hole 58 and is held by clip 18B, and second the rear pin 20 is pressed through hole 62 to force the alignment tool 52 entirely out of the rear holes of the launcher tube and the day sight and is held by clip 20B. The night sight cradle 12 is removed from launcher tube 40 in the reverse order after the weapon is fired.

We claim:

1. A sight assembly that is detachably connectable to a small defense weapon, said assembly comprising:

a mounting cradle; and a sight, said sight having a belt-type bracket that is screw-tightened about the sight and is connected to a plate of the mounting cradle, said plate having a front leg and a rear leg which extends down therefrom and to which are attached front or rear connecting/disconnecting means respectively; and wherein the front leg and the rear leg each are provided with antirocking means to prevent rocking of the sight assembly, when attached to a weapon, about points of attachment of the connecting/disconnecting means.

2. The sight assembly as set forth in claim 1 in which said front or rear connecting/disconnecting means contain holes that are aligned with holes in an air defense launcher tube and wherein said antirocking means is comprised of at least one antirocking pin offset from said holes such that said antirocking pin fits into a slot in said launcher tube.

3. An assembly as set forth in claim 2 wherein said sight is a thermal viewer that operates in the 3–5 $\mu$M range and is cooled by a thermoelectric cooler.

4. An assembly as set forth in claim 2 wherein said sight is a thermal viewer that operates in the 8–12 $\mu$M range uncooled.

5. The combination of the assembly as set forth in claim 3 and an alignment tool, wherein the alignment tool has a cylindrical member having a diameter smaller than the diameter of said holes.

6. The combination as set forth in claim 5 wherein said sight has a circular reticle on an eyepiece thereof wherein an operator can determine that an enemy target is in range of said weapon when said target fills said circular reticle.

7. The combination as set forth in claim 6 wherein said sight has an elongated housing with in-line optics therein.

8. A method of mounting a quick connect/disconnect sight on a shoulder held launcher tube of a defense weapon comprising:

providing an attachable mounting cradle having a front leg and a rear leg containing holes and extending down from an elongated slotted flat plate such that said legs are form fitted to the launcher tube, said launcher tube including front and rear eyerings extending therefrom, said eyerings each containing a hole such that the hole in said front leg and the hole in said rear leg are matched with the hole in the respective eyering of the launcher tube, and wherein there is provided on at least one eyering a second hole, said mounting cradle further comprising an antirocking pin on one of said legs such that the antirocking pin is offset from said hole in said leg;

attaching a sight having a belt-type bracket that is screw-tightened about the sight to the slotted flat plate of the mounting cradle by screw threadably connecting the bracket to said flat plate through said slot;

quick connecting the sight mounted cradle onto said launcher tube by inserting said antirocking pin into the second hole of one of the eyerings of said launcher; aligning the front and rear holes of said legs and of said eyerings and inserting launcher-lanyard-connected, push-button-releasable, slip rings through the matching front and rear holes of the legs and eyerings to secure the sight mounted cradle on said launcher; and, releasing the push button to remove said sight mounted cradle.

* * * * *